United States Patent [19]

Höveler

[11] 4,206,012

[45] Jun. 3, 1980

[54] PICK-UP ELEMENT FOR LABELS IN A LABELING MACHINE

[75] Inventor: Egon Höveler, Haan, Fed. Rep. of Germany

[73] Assignee: Jagenberg Werke AG, Düsseldorf, Fed. Rep. of Germany

[21] Appl. No.: 964,095

[22] Filed: Nov. 24, 1978

[30] Foreign Application Priority Data

Nov. 30, 1977 [DE] Fed. Rep. of Germany ..... 2753344

[51] Int. Cl.[2] ..... B65C 9/08; B65C 11/04; H05B 33/28

[52] U.S. Cl. ..... 156/571; 118/211; 156/578

[58] Field of Search ..... 156/571, 578; 118/211, 118/212, 204; 427/210, 211, 256, 278, 277

[56] References Cited

U.S. PATENT DOCUMENTS

| | | | |
|---|---|---|---|
| 2,338,558 | 1/1944 | Wickwire | 427/256 |
| 3,567,559 | 3/1971 | Dullinger | 156/571 |
| 3,865,671 | 2/1975 | Kronsder | 156/578 |
| 3,919,040 | 11/1975 | Zodrow | 156/578 |

*Primary Examiner*—Douglas J. Drummond
*Attorney, Agent, or Firm*—Sprung, Felfe, Horn, Lynch & Kramer

[57] ABSTRACT

In a labeling machine including means for supplying labels to a pickup element supplied with adhesive, which element transfers the labels to a gripping cylinder, the improvement wherein such pickup element has a smooth convex take-up surface composed of a plurality of first areas spaced form one another by second areas, the first areas exhibiting good adhesion properties and the second areas being relatively non-adherent, whereby when an adhesive is applied to said surface it lays substantially exclusively on the good adhering areas while leaving the non-adherent areas substantially free of adhesive, whereby less adhesive is required. The adherent areas may be metal and the non-adherent areas polytetrafluoroethylene provided in recesses in the metal, the non-adherent areas being in the form of circles or stripes.

7 Claims, 4 Drawing Figures

„E"

PICK-UP ELEMENT FOR LABELS IN A LABELING MACHINE

The invention relates to a pickup element for labels in a labeling machine with a convex, smooth take-up surface which permits the application of adhesive thereto and has good adhesion properties.

According to German Offenlegungsschrift No. 2,435,582, such pickup element for labels belongs to the prior art. The pickup element is seated on a drive shaft and is used for the gluing of labels which are received by the gripping cylinder from the pickup element. In turn, the gripper cylinder applies the labels to the bottles.

Since the known pickup elements with smooth take-up surface require a relatively large amount of adhesive for each label, it has been suggested to provide the smooth surface with holes (honeycomb fashion), thereby reducing the consumption of adhesive by up to 30%. According to applicant's findings and experiences, such honeycomb gluing had the disadvantage that the adhesive collected in the holes provided in the smooth surface, and the pickup element threw off the accumulated adhesive in droplets from these holes.

It is one object of the present invention to provide a pickup element which significantly reduces the use of adhesive while at the same time ensuring the uniform application of adhesive and not promoting any accumulations thereof.

In a pickup element with a smooth take-up surface to which an adhesive is applied, the object of the invention is realized by providing in the smooth take-up surface first areas with good glue adhesion properties and second areas of significantly lesser adhesion, these areas being alternated and arranged side by side uniformly across the surface. In practice, metal surfaces, particularly those of aluminum, are known to be such surfaces with good glue adhesion properties. Thus, the known pickup elements are of cast aluminum, i.e. their take-up surface is also of aluminum. According to the invention the uniformity of the take-up surface is disrupted by a plurality of second surfaces while a smooth surface is maintained. To this end, there are provided in the metal take-up surface preferably glue-repelling plastic surfaces, especially of polytetrafluoroethylene. These adhesive-rejecting surfaces constitute advantageously 35 to 65%, and especially 45 to 60%, of the smooth take-up surface to which the adhesive is applied. To obtain a fine and uniform distribution of the surfaces, their width is advantageously between 0.5 and 8 mm. The second surfaces can be arranged on the take-up surface in a checker-board pattern or in honeycomb form. A striped pattern has been successfully used, wherein the first and second surfaces are preferably of a stripe width of between 0.5 and 4 mm. In this type of stripe arrangement it is particularly advantageous that the stripes are arranged circumferentially on the convex take-up surface since the labels can then be easily removed from the pickup element.

In the honeycomb arrangement of the first and second surfaces, it proved to be advantageous when the honeycomb-like design is surrounded on its perimeter by a continuous border which has good glue adhesion properties. When labels are subject to moisture after they are applied to objects, the said continuous edge will advantageously prevent moisture from reaching underneath the labels and thereby causing them to peel off.

The particular advantages of the pickup element according to the invention are described hereinafter.

When compared with known smooth take-up surfaces, it was shown that the consumption of adhesive is reduced by more than 50% since the adhesive does not adhere to the glue-rejecting surfaces. There are no problems caused by accumulating adhesive, since the adhesive cannot collect on the smooth take-up surface.

Another essential advantage is the fact that the labels can be removed much easier from the pickup element. This is particularly desirable for labels which are not tear-resistant, for example for those of thin foil or easily torn paper. Thus, by using the pickup element according to the invention, the number of rejected labels is greatly reduced.

The second surfaces of lesser adhesion properties are applied in a simple process to the known metal take-up surfaces. When a plastic of significantly lower adhesion (less than ½ the adhesion properties of the first surfaces) is to be applied to the take-up surface, it is only necessary to cut grooves of a depth of a few 10th mm at the desired intervals in the take-up surface. The plastic is subsequently sprayed and baked onto the take-up surface, and the object is then smoothed down to the level of the smooth take-up surface.

It has been particularly successful to spray and bake polytetrafluoroethylene onto the surface, and it results in a good and lasting bond between the plastic and the metal base, while the polytetrafluoroethylene at the same time rejects the adhesive.

BRIEF DESCRIPTION OF THE DRAWINGS

The object of the present invention is described hereinafter with reference to the drawings, wherein:

FIG. 2*a* is an enlarged detail "E" in FIG. 2,

DETAILED DESCRIPTION OF THE INVENTION

Figure 1:
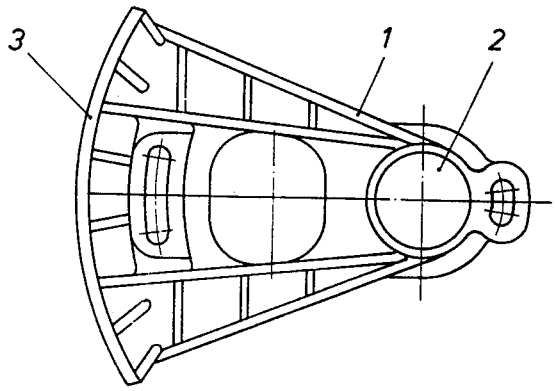
FIG. 1 is a top view of the pickup element.

Referring now to FIG. 1, the known form of a pickup element 1 is shown which is mountable with its bore 2 on a drive shaft (not shown) and which has the take-up surface 3 on its outer side.

Figure 2:
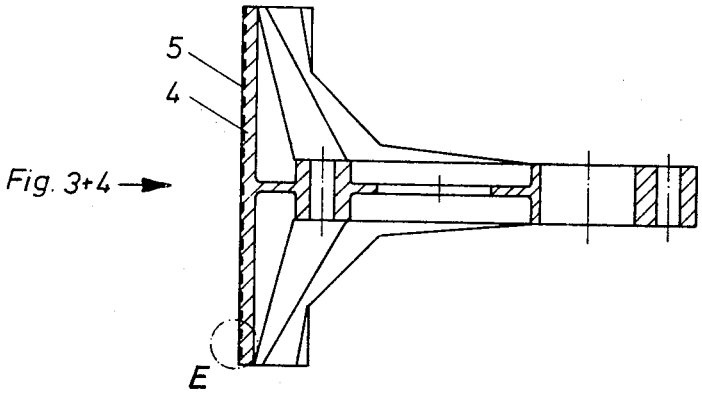
FIG. 2 is a longitudinal section through the pickup element.
Figure 2:
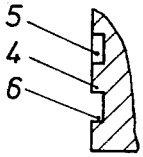

The longitudinal sectional view in FIG. 2 shows that the take-up surface 3 is smooth, but that the smooth take-up surface 3 is formed of first surfaces 4 and second surfaces 5. The first surfaces 4 are of the basic material, e.g. aluminum, and the second surfaces are of polytetrafluoroethylene. The detail E in FIG. 2*a* shows that the second surfaces are provided in recesses 6 of the basic material.

Figure 3:
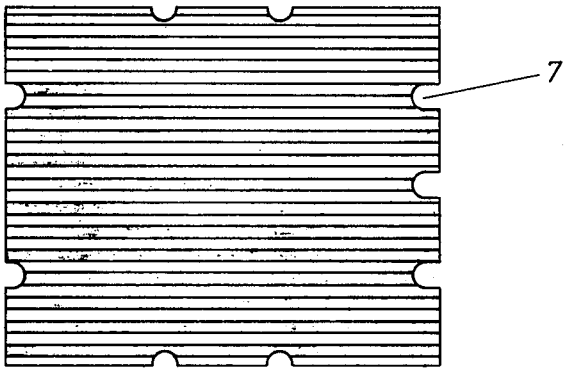
FIG. 3 is a plan view of the take-up surface of the pickup element.

As shown in the top view in FIG. 3, a striped pattern results, wherein the longitudinal stripes are in the direction of the circumference of the convex take-up surface. The strips of the first and second surfaces 4 and 5 each have a width of approximately 1.5 mm. To provide second surfaces 5 in the take-up surface 3, grooves of a depth of approximately 2/10 mm are cut into the metal surface. These grooves are filled with polytetrafluoroethylene such that a smooth take-up surface 3 results.

The notches 7 provided in the pickup surface 1 permit the removal of the label by the gripper elements of the gripper cylinder (not shown).

Figure 4:
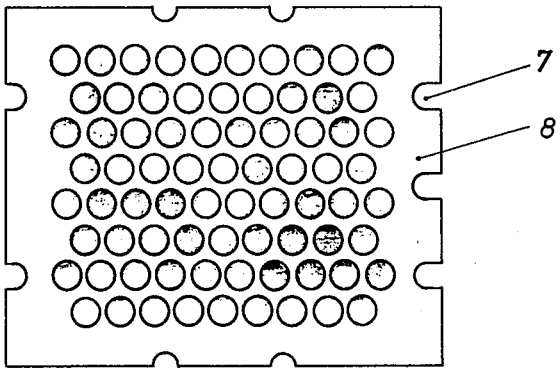
FIG. 4 is a plan view of an alternative embodiment of FIG. 3.

In an alternative embodiment according to FIG. 4, the first surfaces 4 and the second surfaces 5 are arranged in honeycomb fashion. In this embodiment, it is essential that the honeycomb structure has a continuous border 8 around its periphery. This continuous edge is part of the first surface 4 and ensures a uniform and continuous application of adhesive on the periphery of the label which is advantageous for labels which are subject to moisture.

It was shown that more than 40% (e.g. approximately 50%) of the adhesive commonly used in labeling machines can be saved when the pickup element according to the invention is used. It is furthermore considerably easier to remove the label from the pickup element and the number of rejects is significantly reduced thereby.

It will be appreciated that the instant specification and claims are set forth by way of illustration and example and that various modifications and changes may be made thereto without departing from the spirit and scope of the present invention.

What is claimed is:

1. A pickup element for labels in a labeling machine having a smooth convex take-up surface, the surface being composed of a plurality of first areas spaced from one another by second areas, the first areas exhibiting good adhesion properties and the second areas being relatively non-adherent, whereby when an adhesive is applied to said surface it lays substantially exclusively on the good adhering areas while leaving the non-adherent areas substantially free of adhesive.

2. A pickup element according to claim 1, wherein the non-adherent areas constitute from about 35 to 65% of the take-up surface.

3. A pickup element according to claim 1, wherein the non-adherent areas are composed of polytetrafluoroethylene.

4. A pickup element according to claim 3, wherein the adherent areas are metal.

5. A pickup element according to claim 4, wherein the metal areas are contiguous and form a border surrounding the polytetrafluoroethylene areas.

6. A pickup element according to claim 4, wherein the areas are horizontal stripes on the surface.

7. In a labeling machine including means for supplying labels to a pickup element supplied with adhesive, which element transfers the labels to a gripping cylinder, the improvement wherein such pickup element has a smooth convex take-up surface according to claim 1, whereby less adhesive is required.

* * * * *